US007165647B2

(12) United States Patent
Lee

(10) Patent No.: US 7,165,647 B2
(45) Date of Patent: Jan. 23, 2007

(54) MECHANICAL ACOUSTIC FILTER BY EROSION ETCHING

(76) Inventor: Pei-Chau Lee, P.O. Box No. 6-57, Junghe, Taipei 235 (TW)

( * ) Notice: Subject to any disclaimer, the term of this patent is extended or adjusted under 35 U.S.C. 154(b) by 398 days.

(21) Appl. No.: 10/737,965

(22) Filed: Dec. 18, 2003

(65) Prior Publication Data

US 2005/0135648 A1 Jun. 23, 2005

(51) Int. Cl.
*H04R 7/26* (2006.01)
*G10K 13/00* (2006.01)

(52) U.S. Cl. ..... 181/160; 181/158; 181/242; 381/372

(58) Field of Classification Search ..... 181/160, 181/166; 381/372
See application file for complete search history.

(56) References Cited

U.S. PATENT DOCUMENTS 2,487,038 A * 11/1949 Baum ..... 181/135
2,645,301 A * 7/1953 De Vries ..... 181/290
2,656,004 A * 10/1953 Olson ..... 181/295
3,312,789 A * 4/1967 Lewis et al. ..... 381/323
3,944,756 A * 3/1976 Lininger ..... 381/355
4,189,627 A * 2/1980 Flanagan ..... 381/353
4,418,787 A * 12/1983 Eggert et al. ..... 181/130
4,451,709 A * 5/1984 Waxman ..... 381/327
4,628,740 A * 12/1986 Ueda et al. ..... 73/705
5,262,021 A * 11/1993 Lehmann et al. ..... 205/655
5,490,220 A * 2/1996 Loeppert ..... 381/355
5,579,398 A * 11/1996 Ewens ..... 381/338
5,870,482 A * 2/1999 Loeppert et al. ..... 381/174
2003/0098199 A1* 5/2003 Ashida et al. ..... 181/229

* cited by examiner

*Primary Examiner*—Edgardo San Martin
(74) *Attorney, Agent, or Firm*—Marshall, Gerstein & Borun LLP

(57) ABSTRACT

A mechanical acoustic filter is formed of boards made by using erosion etching. The filter may be used in electric condenser microphones. The filter may be made of one or a plurality of boards each being made by erosion etching according to different requirements. The boards can be printed circuit boards, ply boards, or of other materials. Every etched board has corresponding paths, which after the boards are assembled, form an acoustic filtering path that not only can extend the length of the path to filter out high frequency noise more efficiently, but also can reduce the entire volume of the microphone assembly.

8 Claims, 9 Drawing Sheets

MECHANICAL ACOUSTIC FILTER BY EROSION ETCHING

BACKGROUND

1. Technical

This patent relates to a mechanical acoustic filter thinner boards manufactured by an erosion etching technique, the mechanical acoustic filter being suitable to be used in electric condenser microphones. The mechanical acoustic filter is to be formed as one or a plurality of boards by erosion etching according to different requirements. Every etched board has corresponding path which, after the boards are assembled, form a sound filtering path.

2. Background

Conventional mechanical acoustic filters are mostly formed by injection molding. However, the present structures can not eliminate the short comings of the acoustic filtering path being too long thus not able to reduce the entire volume of the microphone and unable to reduce high frequency noise.

SUMMARY

A mechanical acoustic filter is made using erosion etching. The acoustic filter is formed by one or a plurality of boards, wherein the boards are formed using erosion etching. The boards formed in this manner are thinner and can reduce the space occupied by the mechanical acoustic filter. The inside of the filter has a certain length of wave filtering path, which has bends and turns that efficiently extend the length of the path and can efficiently reduce high frequency noise as compared to mechanical acoustic filter formed by injection molding.

To enable a further understanding of the said objectives and the technological methods of the invention herein, the brief description of the drawings below is followed by the detailed description of the preferred embodiment.

DETAILED DESCRIPTION OF THE PREFERRED EMBODIMENTS

Figure 1:
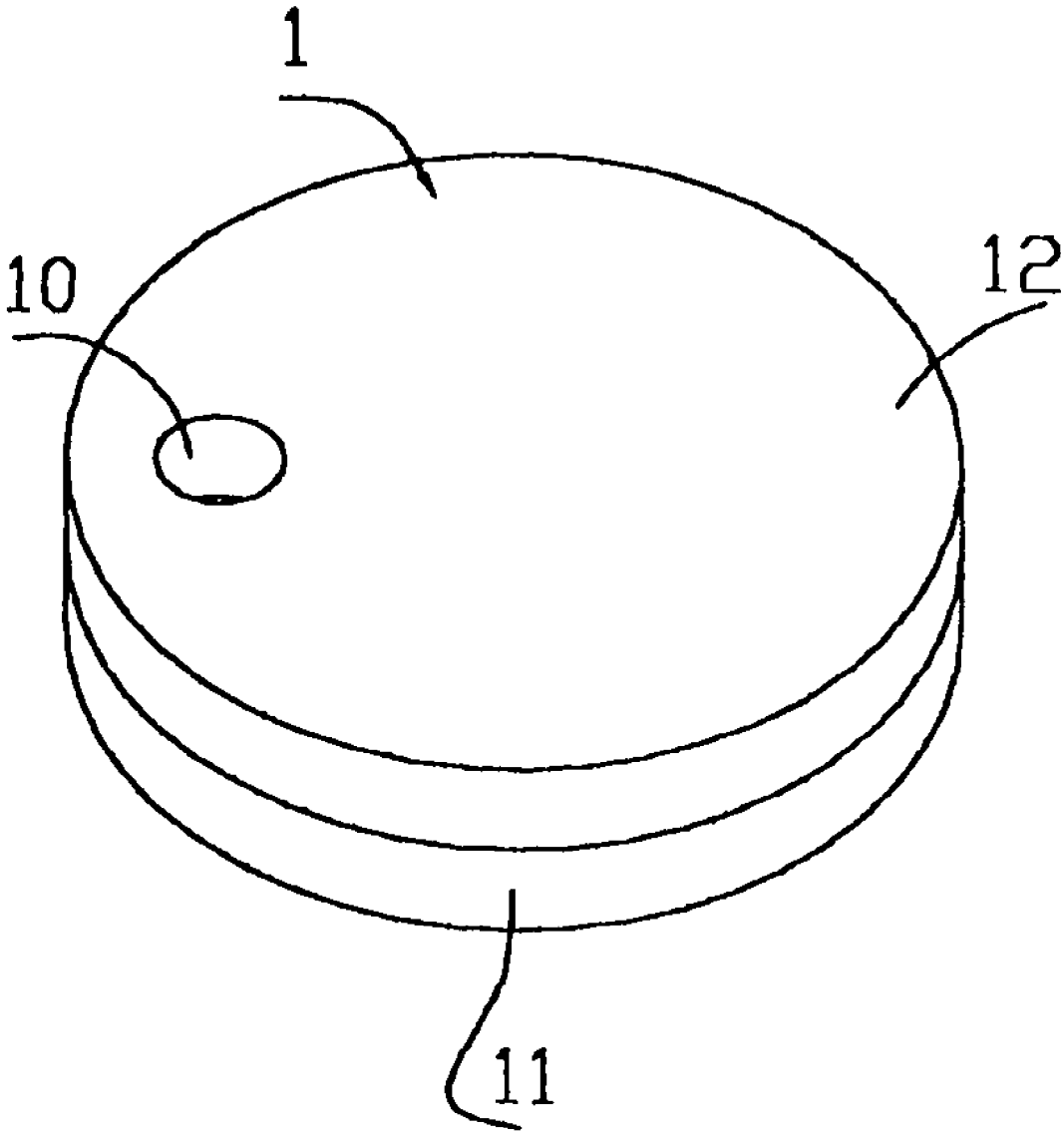
FIG. 1 shows a perspective view of the entire structural combination according to the invention.
Figure 2:
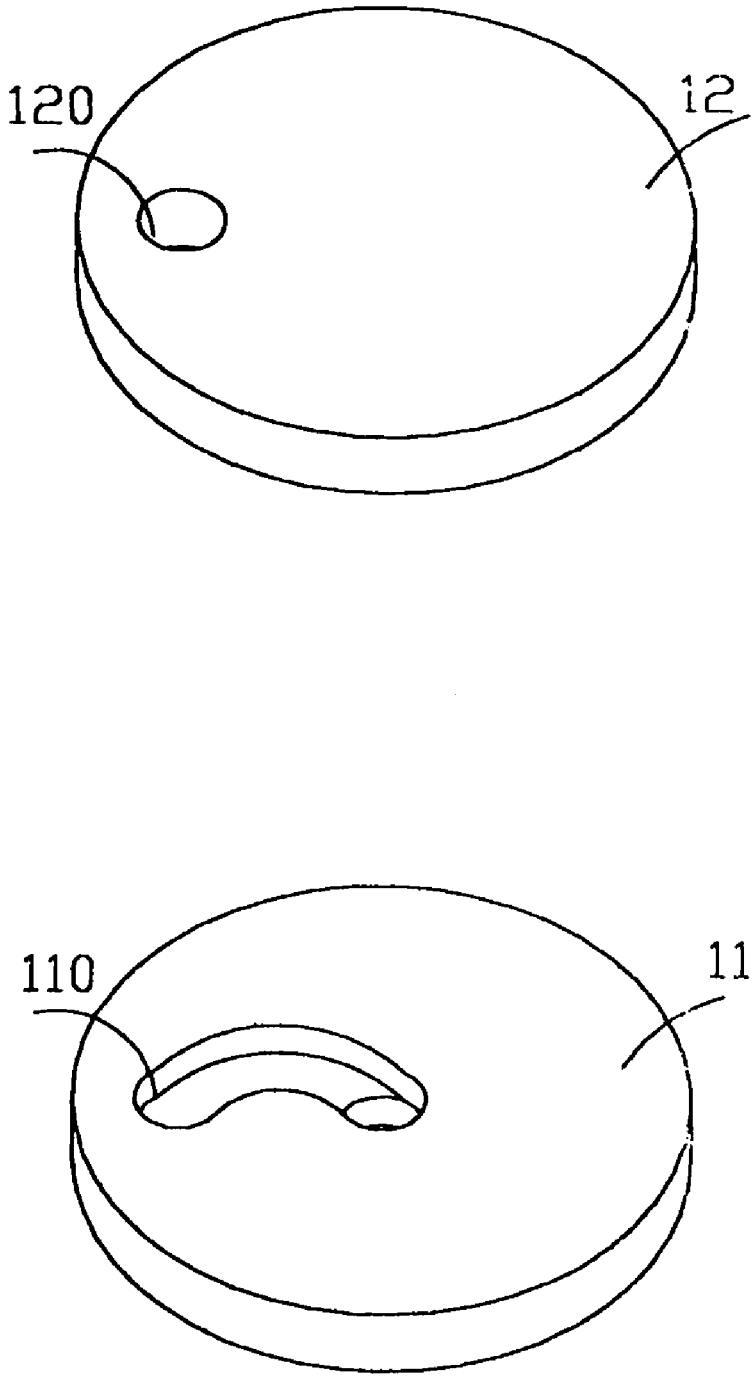
FIG. 2 shows a schematic view of the different units according to the invention.
Figure 3:
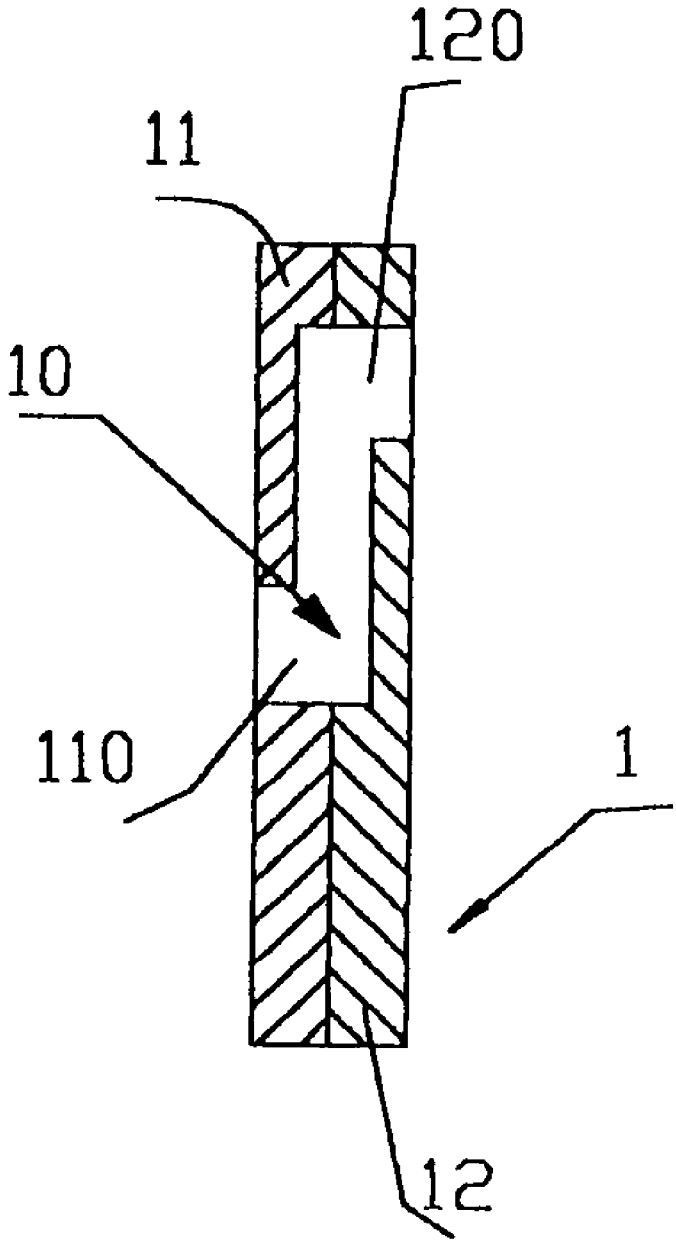
FIG. 3 shows a side cross-sectional view of the complete assembly according to the invention.
Figure 4:
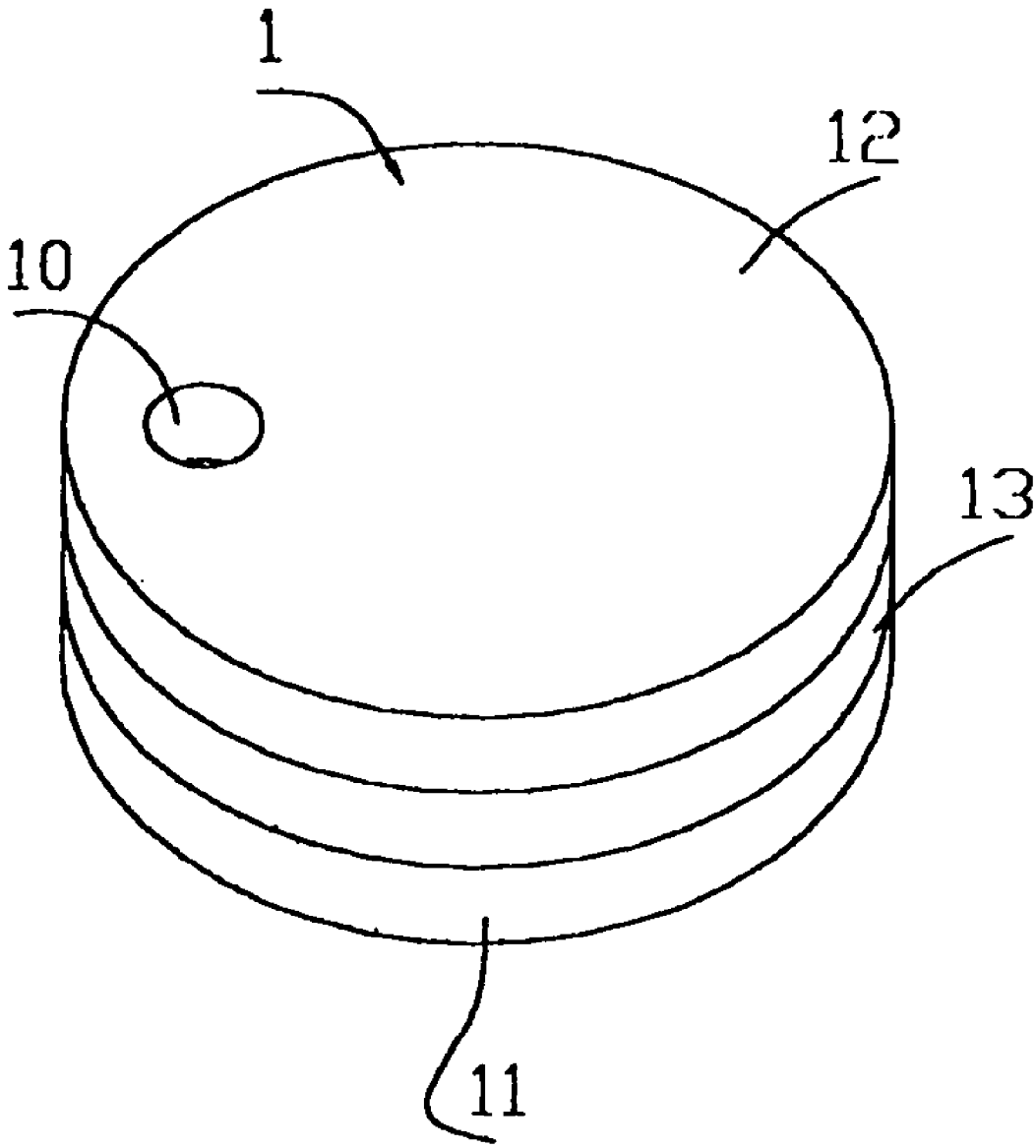
FIG. 4 shows another perspective view of the entire structural combination according to the invention.
Figure 5:
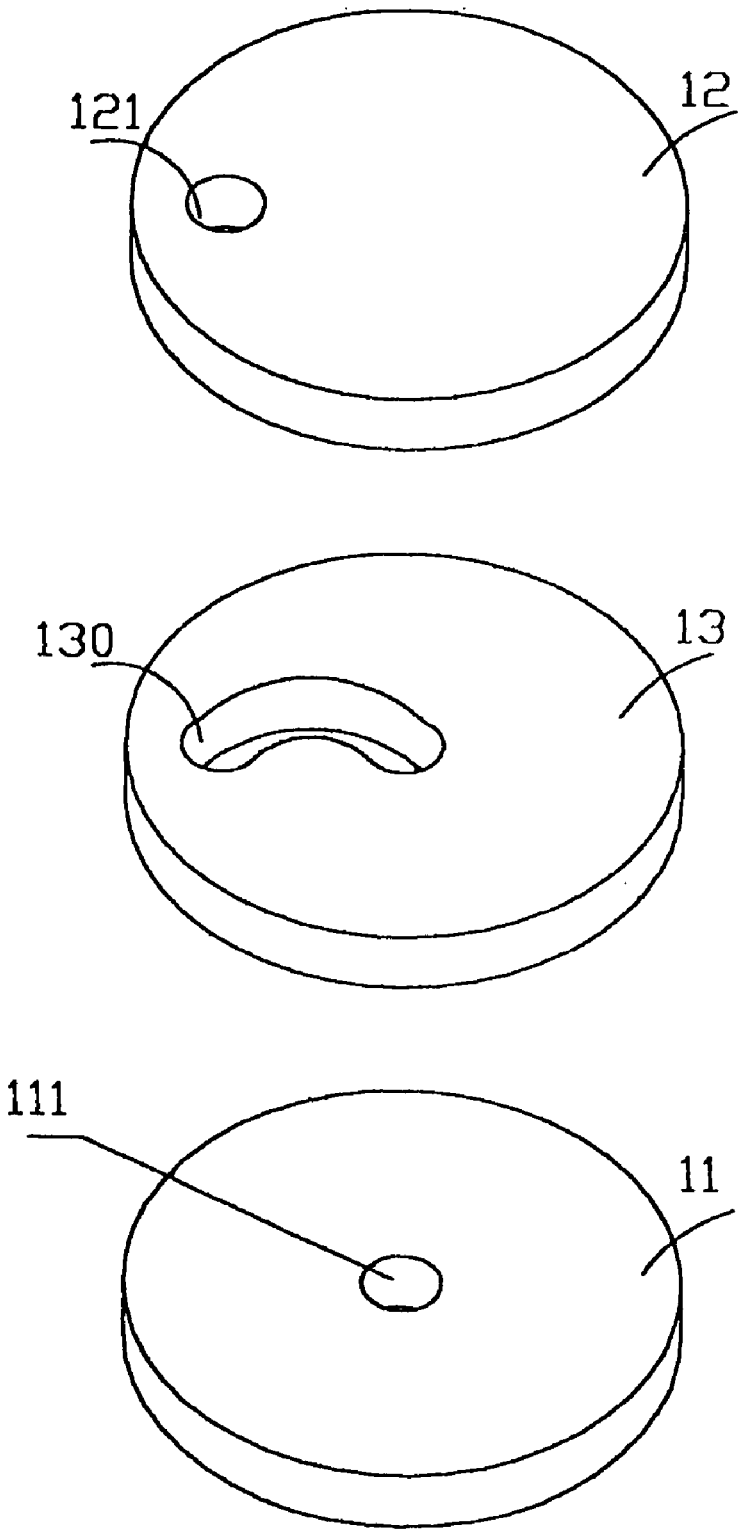
FIG. 5 shows another schematic view of the different units according to the invention.
Figure 6:
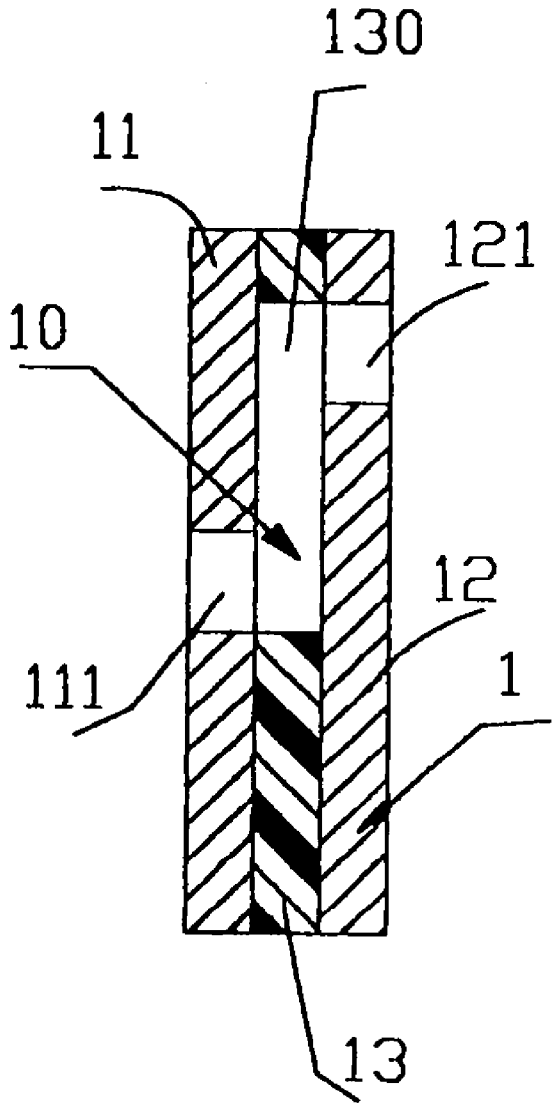
FIG. 6 shows another side cross-sectional view of the complete assembly according to the invention.
Figure 7:
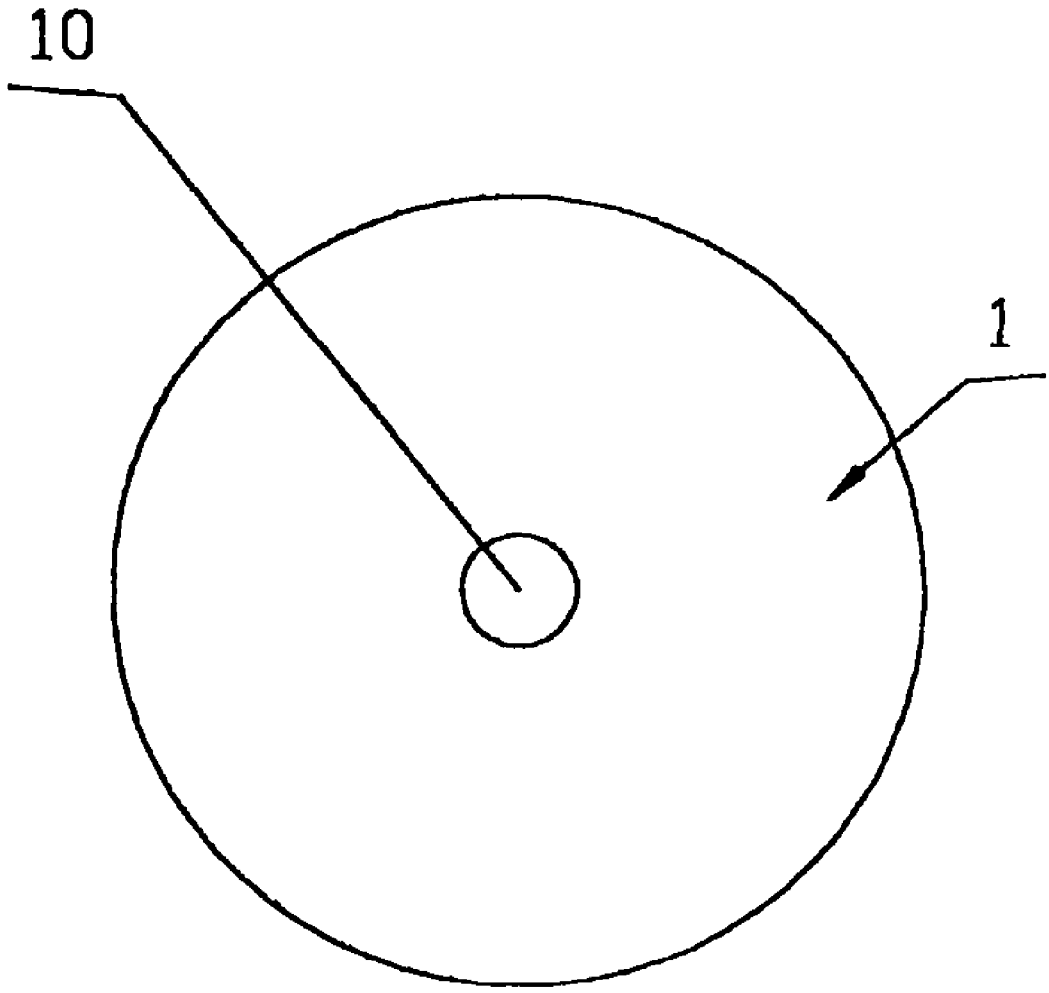
FIG. 7 shows a bird's eyes view of the entire structural combination according to the invention.

To better understand the characteristics and novelties of the invention, descriptions shall be given with the accompanying drawings hereunder.

Referring to FIGS. 1–7, a mechanical acoustic filter (1) is formed based on individual requirement from boards (11, 12) made by using erosion etching technique. The filter (1) can be a single board being etched to form a wave filtering path (10) or a plurality of boards (11, 12), as depicted, assembled together after etching.

The filter (1) can be a printed circuit board, plurality of boards, or made of other different materials. When the filter (1) is formed from adhering two boards together (11, 12) a first groove (110) is etched on the first board (11) to correspond to a second path (120) on a the second board (12) resulting in a the wave filtering path (10). This construction allows the path (10) to bend and turn thus extending the length of the path (10) efficiently.

When the filter (1) is formed from three boards (11, 12, 13), a third groove (130) can be etched on the third board (13) to correspond to a first path (111) on the first board (11) and a second path (121) on the second board (12). When path (111), (121), and (130) are joined, a the wave filtering path (10) is formed. Again the wave filtering path (10) may be made to bend and turn allowing for extending the path (10) efficiently.

When the filter (1) is formed from a single board, etching is also applicable to etch out an acoustic filtering path (10) having a smaller radius than that formed by injection molding.

Figure 8:
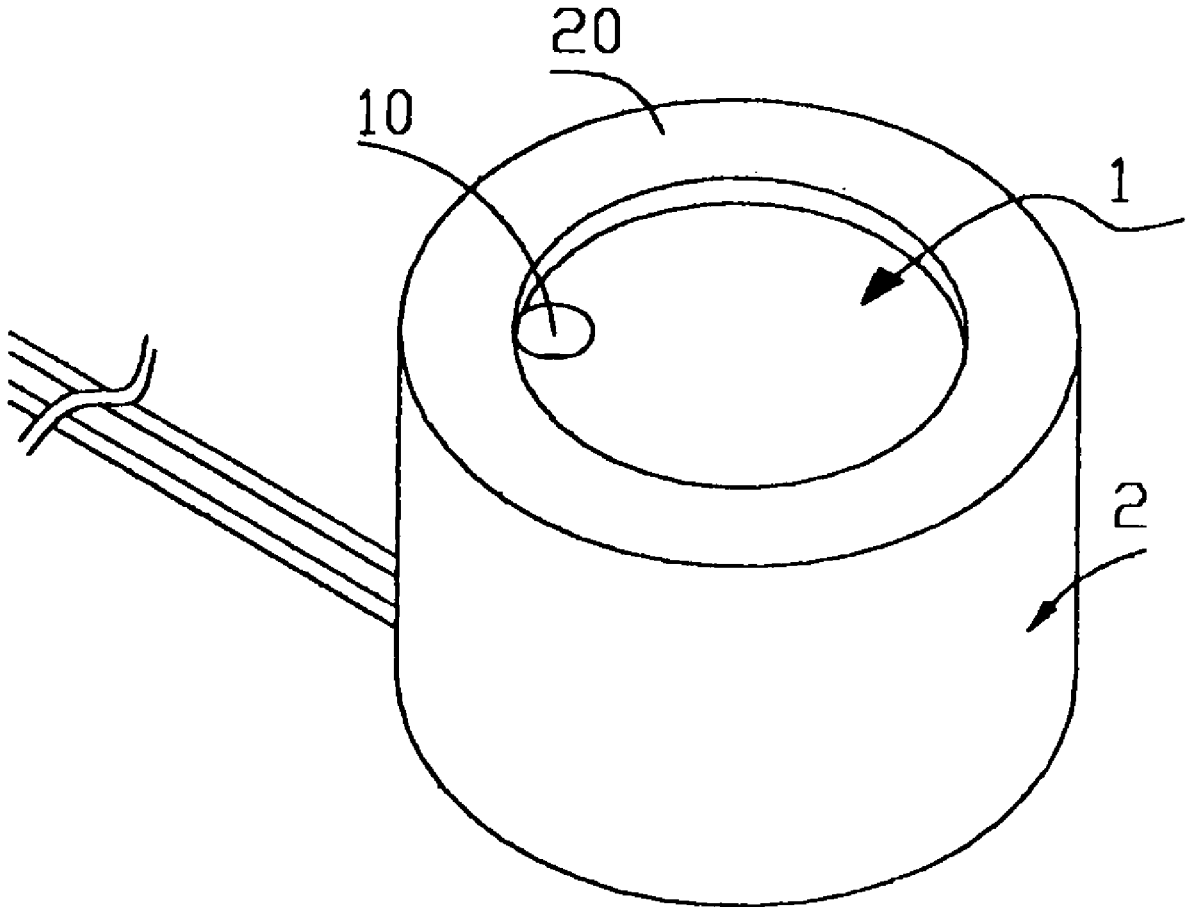
FIG. 8 shows the schematic view of a preferred embodiment of the entire structural combination according to the invention.
Figure 9:
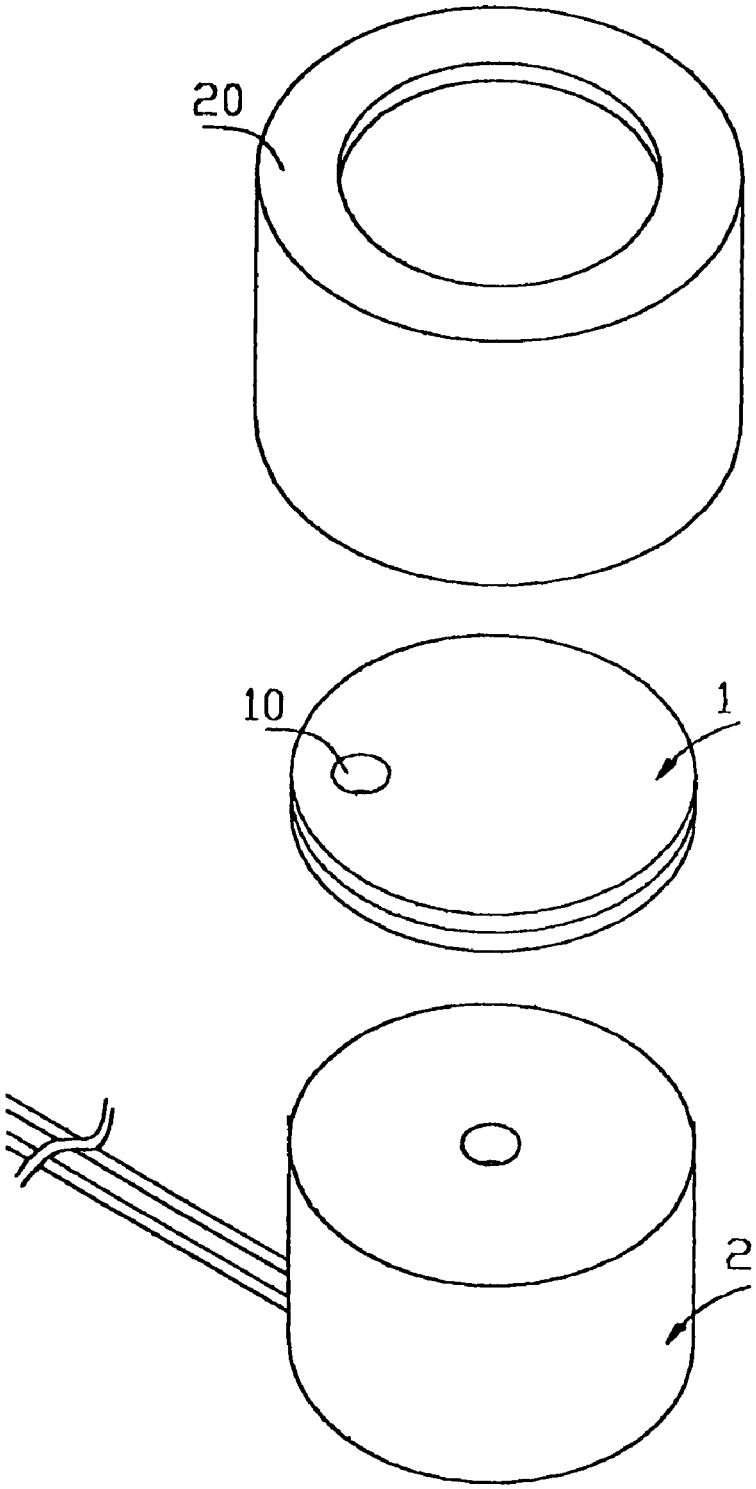
FIG. 9 shows the best exploded view of the preferred embodiment of the entire structural combination according to the invention.

Referring to FIGS. 8–9, when installing a filter (1) in accordance with the embodiments of the invention, filter (1) is positioned adjacent a microphone (2) and secured by a cover (20) affixed on the microphone (2).

When using a filter (1) in accordance with embodiments of the invention inside the microphone (2), due to reduced thickness of the filter (1), the size of the microphone (2) can also be minimized.

It is of course to be understood that the embodiment described herein is merely illustrative of the principles of the invention and that a wide variety of modifications thereto may be effected by persons skilled in the art without departing from the spirit and scope of the invention as set forth in the claims.

What is claimed is:

1. A mechanical acoustic wave filter comprising:

a first board member, the first board member having an erosion etched first path portion formed in the first board member;

a second board member, the second board member having an erosion etched second path portion formed in the second board member; and the first board member and the second board member being joined together with the erosion etched first path portion and the erosion etched second path portion being communicatively coupled to form a filter wave path for the mechanical acoustic wave filter, wherein the erosion etched first path portion comprises a first bend portion and the erosion etched second path portion comprises a second bend portion, the first bend portion and the second bend portion being communicatively coupled to form a bend of the filter wave path.

2. A mechanical acoustic wave filter comprising:

a first board member, the first board member having an erosion etched first path portion formed in the first board member;

a second board member, the second board member having an erosion etched second path portion formed in the second board member;

the first board member and the second board member being joined together with the erosion etched first path portion and the erosion etched second path portion being communicatively coupled to form a filter wave path for the mechanical acoustic wave filter; and the erosion etched first path portion comprising a first through bore erosion etched in the first board member, the first through bore being coupled with a first channel erosion etched into a surface of the first board portion, the erosion etched second path portion comprising a second through bore erosion etched in the second board member, the second through bore being coupled with a second channel erosion etched in a surface of the second board portion, and the first channel and the second channel being aligned together, and the filter wave path extending from the first through bore to the second through bore and including the aligned first and second channels.

3. The mechanical acoustic wave filter of claim 1, the filter comprising a third board member, the third board member having an erosion etched third path portion, the third board member being joined with the first board member or the second board member, the erosion etched third path portion being communicatively coupled with the filter wave path.

4. The mechanical acoustic wave filter of claim 3, the erosion etched first path portion comprising a through bore, the erosion etched second path portion comprising a through bore and the erosion etched third path portion comprising a channel portion, the filter wave path extending from the first through bore to the second through bore and including the channel portion.

5. A microphone comprising:

a housing;

a transducer disposed within the housing; and a mechanical acoustic wave filter disposed within the housing adjacent the transducer, the mechanical acoustic wave filter comprising:

a first board member, the first board member having an erosion etched first path portion in the first board member;

a second board member, the second board member having an erosion etched second path portion in the second board member;

the first board member and the second board member being joined together with the first path portion and the second path portion being communicatively coupled to form a filter wave path for the mechanical acoustic wave filter, wherein the first path portion comprises a first bend portion and the second path portion comprises a second bend portion, the first bend portion and the second bend portion being communicatively coupled to form a bend of the filter wave path.

6. A microphone comprising:

a housing;

a transducer disposed within the housing; and a mechanical acoustic wave filter disposed within the housing adjacent the transducer, the mechanical acoustic wave filter comprising:

a first board member, the first board member having an erosion etched first path portion in the first board member;

a second board member, the second board member having an erosion etched second path portion in the second board member;

the first board member and the second board member being joined together with the first path portion and the second path portion being communicatively coupled to form a filter wave path for the mechanical acoustic wave filter; and the first path portion comprising a first through bore formed in the first board member, the first through bore being coupled with a first channel formed in a surface of the first board portion, the second path portion comprising a second through bore formed in the second board member, the second through bore being coupled with a second channel formed in a surface of the second board portion, and the first channel and the second channel being aligned together, and the filter wave path extending from the first through bore to the second through bore and including the aligned first and second channels.

7. The microphone of claim 5, the filter comprising a third board member, the third board member being erosion etched in order to form a third path portion, the third board member being joined with the first board member or the second board member, the third path portion being communicatively coupled with the filter wave path.

8. The microphone of claim 7, the first path portion comprising a through bore, the second path portion comprising a through bore and the third path portion comprising a channel portion, the filter wave path extending from the first through bore to the second through bore and including the channel portion.

* * * * *